US009968522B2

(12) United States Patent
Sadigh Behzadi

(10) Patent No.: US 9,968,522 B2
(45) Date of Patent: May 15, 2018

(54) GRAVITY TIMER RESET MECHANISM

(71) Applicant: Amir Akbar Sadigh Behzadi, Canoga Park, CA (US)

(72) Inventor: Amir Akbar Sadigh Behzadi, Canoga Park, CA (US)

(73) Assignee: A&D Product Design, Inc., Canoga Park, CA (US)

( * ) Notice: Subject to any disclaimer, the term of this patent is extended or adjusted under 35 U.S.C. 154(b) by 168 days.

(21) Appl. No.: 15/196,341

(22) Filed: Jun. 29, 2016

(65) Prior Publication Data

US 2018/0000693 A1 Jan. 4, 2018

(51) Int. Cl.
*A61J 7/04* (2006.01)

(52) U.S. Cl.
CPC ..... *A61J 7/0436* (2015.05)

(58) Field of Classification Search
CPC ..... A61J 7/0436; A61J 7/0427
USPC ..... 200/19.15, 19.31, 61.45 R, 61.52
See application file for complete search history.

(56) References Cited

U.S. PATENT DOCUMENTS 3,183,321 A 5/1965 Miller
4,099,040 A 7/1978 Bitko
4,135,067 A 1/1979 Bitko
4,912,687 A 3/1990 Treeby
4,939,705 A * 7/1990 Hamilton ..... A61J 7/0436 221/2
5,155,308 A 10/1992 Blair
5,170,380 A * 12/1992 Howard ..... A61J 7/0472 221/15
5,198,628 A 3/1993 Bitko
5,457,293 A 10/1995 Breed
5,751,661 A 5/1998 Walters
5,953,288 A * 9/1999 Chappell ..... G04B 37/127 215/230
6,518,523 B1 2/2003 Chou
6,667,936 B1 12/2003 Ditzig
6,707,763 B2 3/2004 Osberg
7,061,831 B2 * 6/2006 De La Huerga ..... A61J 1/035 221/129
7,115,824 B2 10/2006 Lo
7,236,428 B1 6/2007 Morse
7,408,843 B2 8/2008 Brandon
8,045,420 B2 10/2011 Newman

* cited by examiner

*Primary Examiner* — Edwin A. Leon
*Assistant Examiner* — Jason Collins
(74) *Attorney, Agent, or Firm* — Trojan Law Offices

(57) ABSTRACT

A medicine container timing apparatus and method of use. The apparatus includes a container, a tilt switch, an electronic timer, and cap with a flange. Within the tilt switch are a gravity response member and a pair of electrical contacts. The cap flange extends into the tilt switch chamber and prevents the electrical contacts resetting the timer by forming a supporting barrier between the contacts and gravity response member. If a user tilts the container when the cap is off, the gravity response member falls onto the pair of electric contacts and resets the electronic timer. However, if the cap is on the container, the flange prevents the gravity response member from causing the electrical contacts to contact each other. The electronic timer therefore only displays the time since the container was last tilted with its cap off.

20 Claims, 6 Drawing Sheets

GRAVITY TIMER RESET MECHANISM

CROSS REFERENCE TO RELATED APPLICATIONS

None.

FIELD OF THE INVENTION

The present invention relates generally to a tilt switch, and more particularly, to a tilt switch that is adapted to be mounted on a pill bottle to reset an electronic timer.

BACKGROUND OF THE INVENTION

Medications often require administration in a series of doses at specific time intervals. For example, some medications require daily administration, while others may require administration every two, four, or six hours. A frequent problem in medication timing is that a patient often cannot remember the last time medication was administered. Patients may forget a dose, thinking that they have already taken their medication, or they may overdose by administering medication too frequently.

There have been many attempts to introduce timers integrated with pill bottles to help patients keep track of the last time they retrieved medication from a pill bottle. Examples of pill bottles with timers are found in Brandon (U.S. Pat. No. 7,408,843), Newman (U.S. Pat. No. 8,045,420), Ditzig (U.S. Pat. No. 6,667,936), Osberg (U.S. Pat. No. 6,707,763), Morse (U.S. Pat. No. 7,236,428) and Walters (U.S. Pat. No. 5,741,661). These pill bottles have timers incorporated into the cap of the pill bottle and the timer automatically resets when the patient removes the cap from the bottle or when the patient replaces the cap back onto the bottle.

To effectuate an automatic timer reset, timer control circuitry in the pill bottle cap is electrically connected to a switch that resets a timer display back to a zero point. Manual timers on pill bottles make use of a physical button near the timer display that patients can press to reset the timer. Patients can tell how long it has been since the last dose by viewing the timer display. Despite the simplicity and usefulness of timers on medicine bottles, they are not without their limitations. One limitation is that for timers with automatic resets based on cap removal, the timer resets whether or not the patient has actually removed any medication from the bottle. Patients can remove the cap, become distracted, and not remember whether they have actually removed any medicine from the bottle. This scenario is especially problematic for patients who are suffering from forgetfulness. Manual timers suffer from the limitation that patients must actually remember to press the timer reset button each and every time they have taken medication. If the timer does not display an accurate time since medication was last removed from the bottle, then the timer is useless.

In view of the above limitations in the field, there currently exists a need in the industry for a simple device that can inform patients how long it has been since medication has been removed from the pill bottle.

All patents, patent applications, and non-patent references disclosed throughout the entirety of this application are hereby incorporated by reference for all purposes in their entireties.

SUMMARY OF THE INVENTION

The present invention provides for a gravity timer reset mechanism. The invention is especially useful as a medicine container, such as a pill bottle, with a timing mechanism that only resets when the container is tilted to retrieve medicine while the container cap is off. If the container is tilted with the cap still on the bottle, the timer does not reset, thereby preventing a reset when the medicine container inadvertently falls over. The timer also does not reset if the cap is removed, but the bottle is not tilted. By combining a timer reset function with a tilt switch that is only activated when the cap is removed, the timer display is far more likely to be measuring the time between actual administration of medication than is the case with prior art devices.

In one embodiment, the apparatus includes a container having a top opening, a tilt switch disposed on the container, an electronic timer, and a cap with a flange. The tilt switch includes a housing, first and second contact terminals, and a gravity response member. The housing of the tilt switch has an inner bottom wall surface, and an inner peripheral wall surface that extends upwardly from a periphery of the inner bottom wall surface. The wall surfaces define boundaries of a channel. The channel has an upper region disposed above a lower region when the tilt switch and container are substantially upright in a typical orientation of a standing pill bottle. The first and second contact terminals in the channel are spaced apart from each other and disposed within the upper region of the channel.

The gravity response member, which can be a ball, cylinder, or other sliding mass, moves from the lower region of the channel to the upper region of the channel in response to a patient tilting the container so that the patient can retrieve pills from the bottle. The gravity response member is capable of applying an actuation force resulting from gravity acting on the gravity response member when the tilt switch is tilted at an angle exceeding a predetermined actuation angle. When the tilt switch is tilted past the predetermined actuation angle, the gravity response member moves to the upper region, thereby causing the first and second electric contact terminals to contact each other, which resets the electronic timer.

The electronic timer of the apparatus is in electrical connection with the tilt switch, and is capable of resetting a timer display. The cap is capable of covering the top opening of the container and includes, or is in physical connection with, a supporting flange. When the cap covers the top of the container to close the container and the tilt switch is tilted at the angle exceeding the predetermined actuation angle, the supporting flange extends into the channel and supports the gravity response member away from the contact terminals. The supporting flange of the cap therefore prevents the gravity response member from engaging contact terminals and resetting the timer when the cap is on, even when the apparatus is tilted.

In one embodiment, the predetermined actuation angle is defined as the angle created from a first orientation of the tilt switch to a second orientation of the tilt switch. In another embodiment, the actuation angle is at least 90 degrees relative to the upright orientation of the apparatus.

In still another embodiment, there is a method of determining the last time a patient has removed medication from the apparatus. The method includes the steps of providing a medicine container timing apparatus as described, removing the cap, tilting the tilt switch at an angle exceeding a predetermined actuation angle, applying the actuation force against the first and second electric contact terminals, and generating an indication of time relating to a time of occurrence of tilting the tilt switch.

BRIEF DESCRIPTION OF THE DRAWINGS

These and other features and advantages of the present invention will become appreciated as the same becomes better understood with reference to the specification, claims, and drawings herein:

DETAILED DESCRIPTION OF THE DRAWINGS

Figure 1:
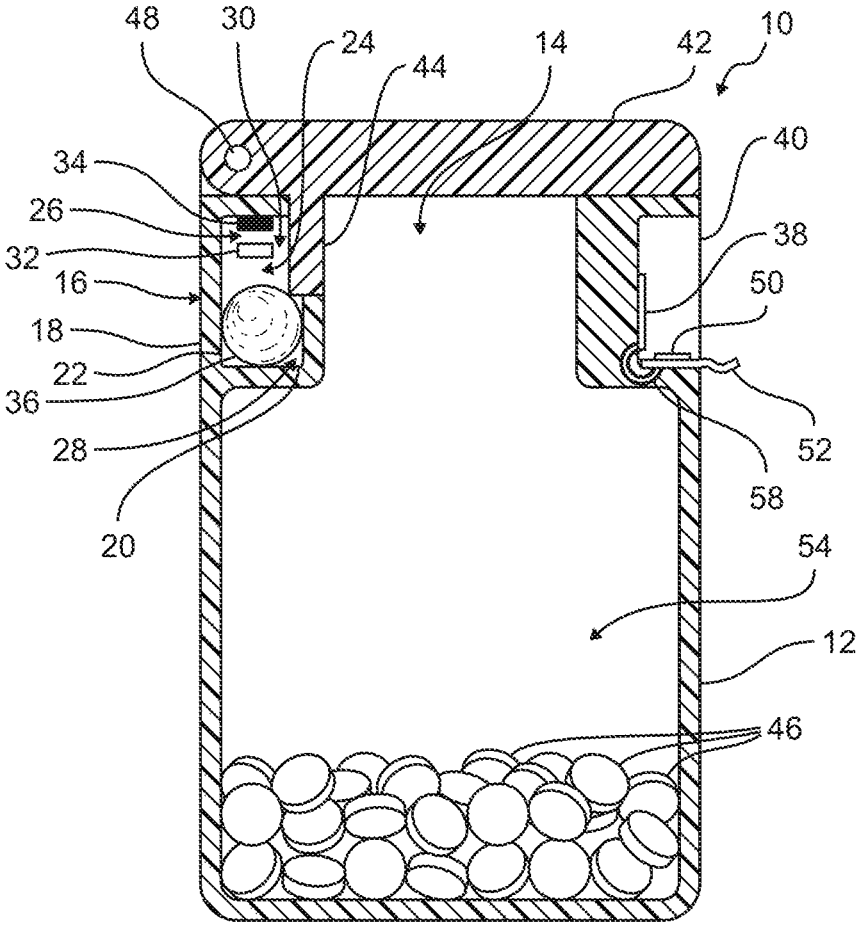
FIG. 1 is a cross sectional side view of the medicine container timing apparatus with a cap covering the top of the container, the apparatus in an upright orientation.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein.

Turning to the Figures, FIG. 1 is a cross sectional side view of the medicine container timing apparatus 10. The apparatus includes a container 12, a tilt switch 16 disposed on the container 12, an electronic timer 38, and a cap 42. The container 12 has a cavity 54, and a top opening 14 where pills 46 can be retrieved when a user tilts the container 12. The tilt switch 16 is disposed on the container and may be within a recessed area of the container 12, or placed on an outside surface of the container 12. The tilt switch has a housing 18, a pair of contact terminals 32, 34, and a gravity response member 36. The housing 18 of the tilt switch 16 has an inner bottom wall surface 20, and an inner peripheral wall surface 20, which extends upwardly from a periphery of the inner bottom wall surface 20 thereby defining a channel 24. The channel 24 has an upper region 26 disposed above a lower region 28 when the container is in an upright orientation. The housing also has an aperture 30 to receive a supporting flange 44 on a cap 42. The aperture 30 should be large enough to receive at least a portion of the flange 44, but small enough to insure that the gravity response member 36 cannot escape from the channel 24. The supporting flange 44 and its purpose are described in more detail below with respect to how the flange prevents the electronic timer 38 from resetting. The pair of contact terminals in the tilt switch includes a first electric contact terminal 32 and a second electric contact terminal 34. The first and second electric contact terminals 32, 34 are spaced apart from each other and disposed within the upper region 26 of the channel 24. The first and second electric contact terminals 32, 33 are preferably made from metal, such as spring steel, and mounted to the housing 18 of the tilt switch 16 by screws, brackets, glue, or equivalent attachment means.

Figure 2:
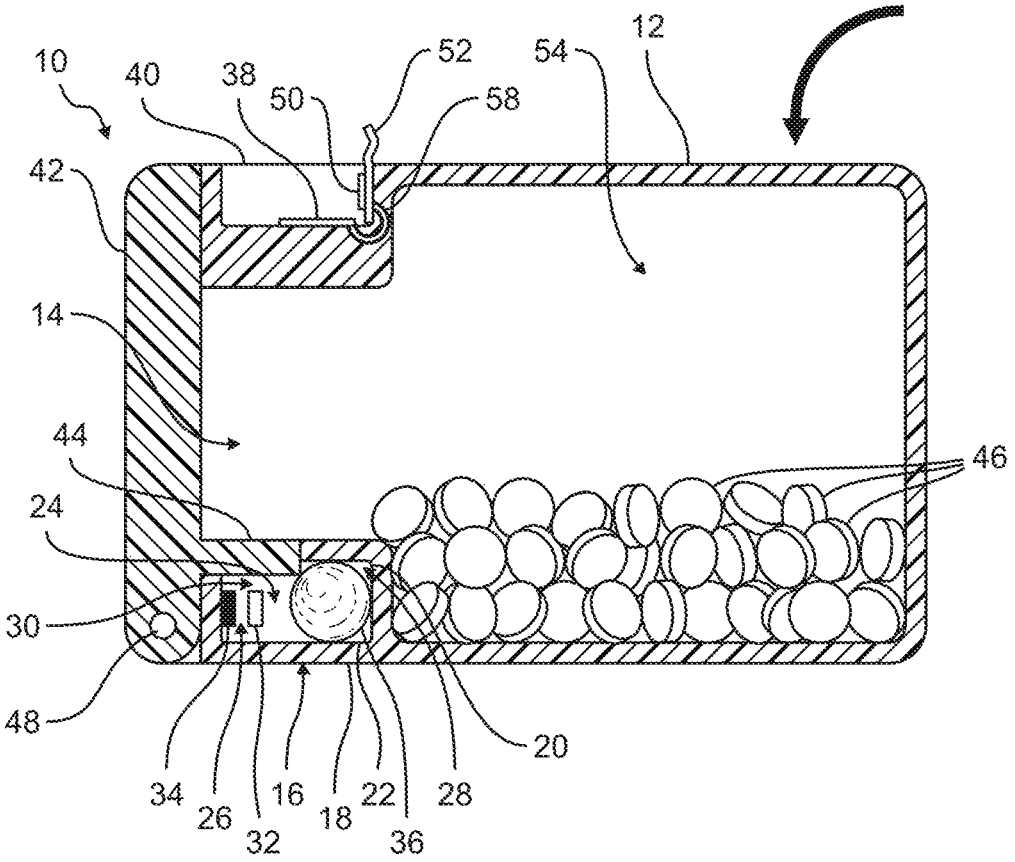
FIG. 2 is a cross sectional side view of the medicine container timing apparatus with a cap covering the top of the container, the apparatus in a tilted horizontal orientation.
Figure 3:
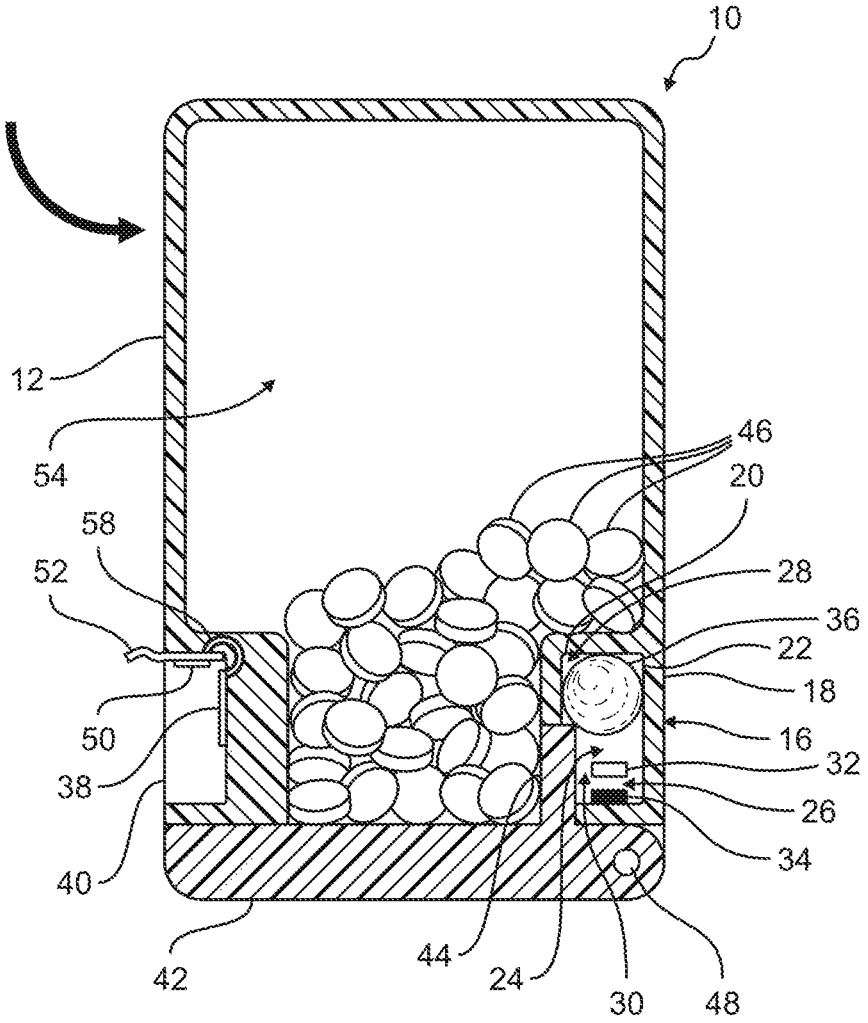
FIG. 3 is a cross sectional side view of the medicine container timing apparatus with a cap covering the top of the container, the apparatus in a tilted upside down orientation.

The gravity response member 36 of the tilt switch is enclosed within the channel 24. The gravity response member can be any number of objects that move in response to gravity. In the embodiment shown in FIG. 1, the gravity response member 36 is a ball, but the gravity response member may be any number of objects that can slide or roll within the channel 24, such as a cylinder or block. The gravity response member 36 slides from the lower region 28 to the upper region 26 of the channel 24 when there is no supporting flange 44 in the channel 24. The supporting flange 44 in the channel 24 blocks the gravity response member's 36 access to the upper region 26, where the electrical contact terminals 32, 34 are located. FIGS. 1-3 show the progression of the apparatus 10 being tilted from an upright position (FIG. 1) to a horizontal position (FIG. 2) to an upside position (FIG. 3) when the cap 44 covers the top of the container 14. Notably, the gravity response member 36 never touches the electric terminals 32, 34 because the flange 44 prevents contact.

FIG. 3 illustrates an embodiment where the cap 44 covers the top opening of the container 12, and the flange 44 is positioned in channel 24 to support the gravity response member 36 by acting as a supporting ledge that the gravity response member 36 rests on when the container 12 is tilted at an angle exceeding a predetermined actuation angle (e.g. upside down). By preventing the gravity response member 36 from moving to the upper region 26 of the channel 24, even when the container 12 is tilted, the supporting flange 44 prevents the gravity response member 36 from contacting the first and second electric contact terminals 32, 34, which therefore prevents the electronic timer 38 from resetting the timer display 40. 12. The flange 44 can be any shape so long as a portion of the flange 44 can pass through the aperture 30 to engage the gravity response member before it resets the timer 38.

As opposed to FIGS. 1-3, FIGS. 4-6 show the same progression of the same apparatus 10 from an upright position (first orientation) (FIG. 4) to a horizontal position (FIG. 5) to an upside position (second orientation) (FIG. 6) when the cap 44 does not cover the top opening 14 of the container. Here, the gravity response member 36 can slide or roll to the upper region 26 when the container 12 is tilted from its upright position to a position that exceeds a predetermined actuation angle (e.g. upside down). In a preferred embodiment, the predetermined actuation angle will be at least 90 degrees horizontal from the upright position of the container 12 and tilt switch 16. Other predetermined actuation angles may be envisioned where the container 12 could be tilted less than or greater than 90 degrees before applying an actuation force to the electric contact terminals 32, 34. It is only in the open cap configurations shown in FIGS. 4-6 that a patient can retrieve pills 46 from the container 12, and the timer 38 will reset.

Figure 4:
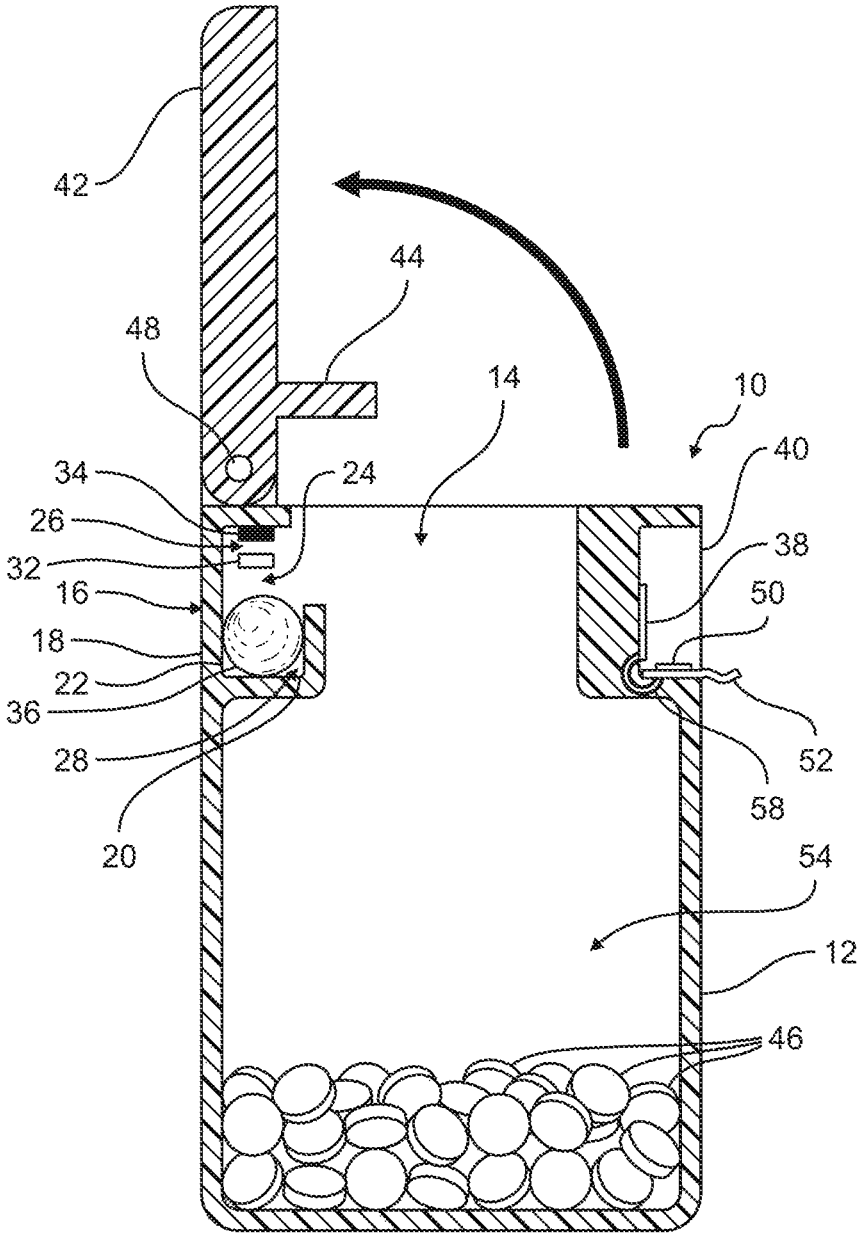
FIG. 4 is a cross sectional side view of the medicine container timing apparatus with the top of the container open, the apparatus in an upright orientation.
Figure 5:
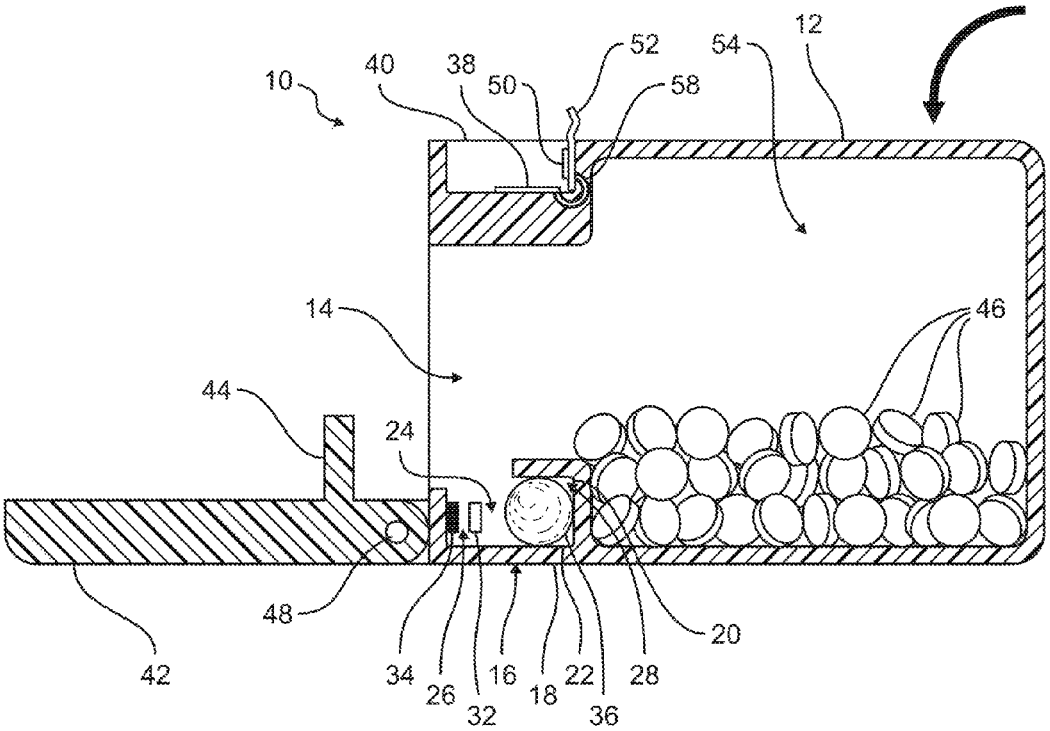
FIG. 5 is a cross sectional side view of the medicine container timing apparatus with the top of the container open, the apparatus in an upright orientation.
Figure 6:
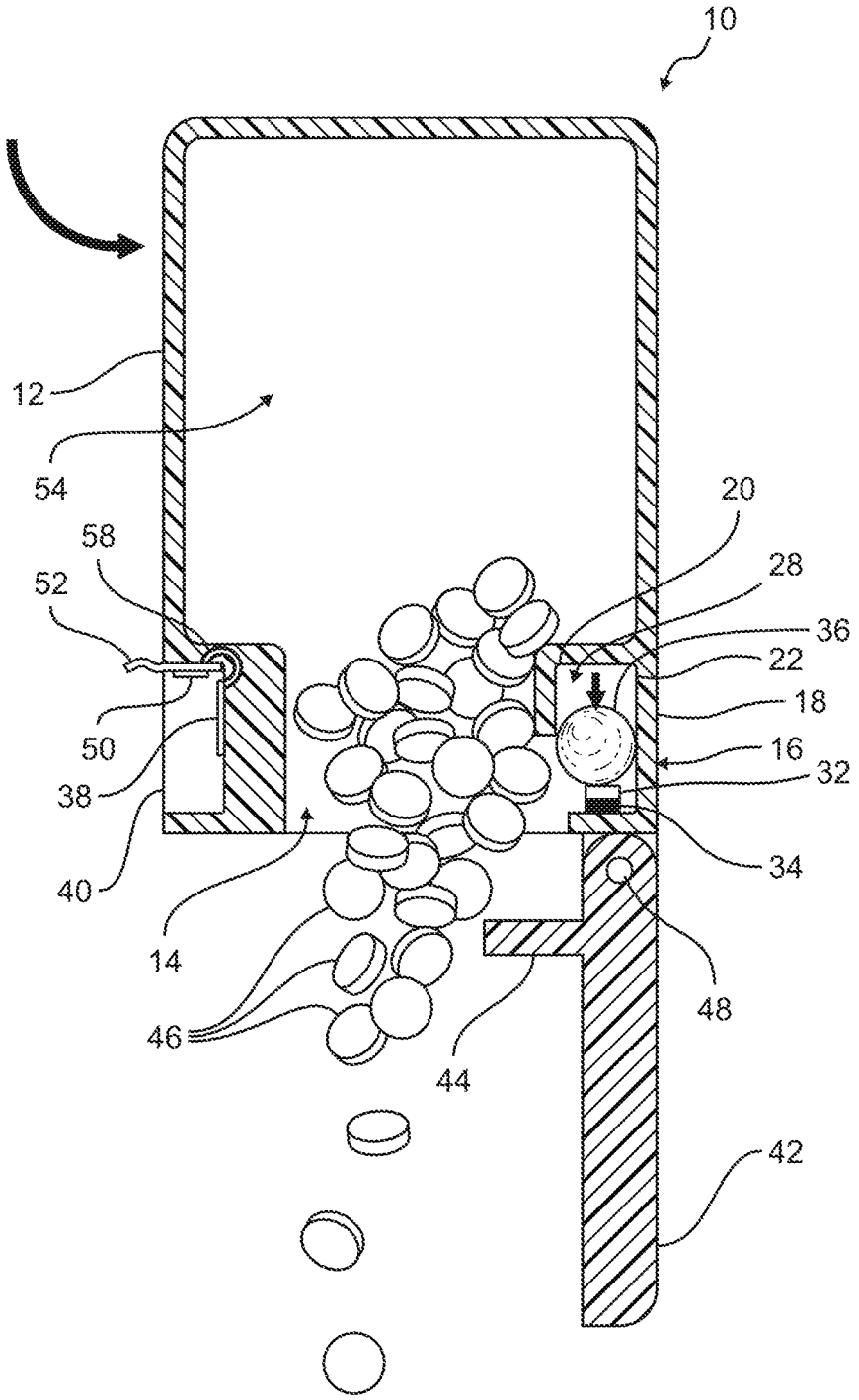
FIG. 6 is a cross sectional side view of the medicine container timing apparatus with the top of the container open top of the container, the apparatus in an upright orientation.

In the open configurations shown in FIGS. 4-6, the gravity response member 36 rolls from the lower region 28 to the upper region 26, an actuating force (caused by gravity) is applied to the pair of electric contact terminals 32, 34, thereby pressing the contact terminals 32, 34 against each other. When the gravity response member 36 presses the electric contact terminals 32, 34 against each other, the formerly open circuit now becomes a closed circuit that imparts a signal to reset the electronic timer 38.

As shown in the Figures, the tilt switch 16 is embodied as a non-magnetic reed switch. The contacts 32, 34 are normally open and only close when physically pressed against each other by the weight of the gravity response member 36 on top of the first electric contact terminal 32. Once the force is removed from the contact terminals 32, 34, (i.e., the ball 36 rolls back to the lower region 28), the contact terminals 32, 34 return to their original open and disconnected position. Other types of switches may be employed where a switch is operable to toggle between two states corresponding to two different orientations. For example, if the gravity response member 36 is a conductive member, such as a metallic ball, and the electrical contacts are horizontally spaced from each other, the metallic ball may form a conductive bridge that electrically connects the two contact terminals to complete a circuit. In a preferred embodiment, the gravity response member is a non-conductive ball and therefore resetting the electronic timer 38 does not rely on the ball itself conducting electricity, but instead only relies on the weight of the ball 36 to press the electrical terminals 32, 34 together.

The contact terminals 32, 34 of the tilt switch 16 are electrically connected to an electronic timer 38 in the apparatus 10. The electronic timer 38 is capable of resetting a time of occurrence of an event on a time display, such as when the tilt switch 16 was last tilted from a first orientation to a second orientation. The cap 42 of the apparatus 10 is capable of being selectively secured or removed from the top opening of the container. In the embodiment shown in FIG. 1, the cap 42 swivels around a hinge 48 that allows the cap to selectively cover or uncover the top opening of the container 14, but the cap is not removed from the container 12 itself. Other embodiments of caps may be envisioned by persons having ordinary skill in the art without straying from the invention. For example, the cap may include a twistable cap having threads, such as those commonly used in child-resistant pill bottles, or may include caps having latches or snaps.

The cap 42 includes a supporting flange 44 adapted to extend into the aperture 30 of the channel 24. When the cap 42 covers the opening of the container 14, at least one portion of the flange 44 is positioned between the gravity response member 36 and electric contact terminals 32, 34. As illustrated, the bottom edge of the flange 44 is between the upper 26 and lower regions 28 of the channel 24. The flange 44 creates a region in the channel 24 that has a diameter less than the diameter of the gravity response member 36 so that the gravity response member 36 cannot slide into the upper region 26, even when the container 12 is tilted upside down (as shown in FIG. 3). Other embodiments may be envisioned that do not narrow the upper region 28, but create some other type of blocking means, such as a bar, protrusion or plate that inserts into the channel 24.

Although FIG. 1 illustrates the flange 44 integral with the cap 42, the flange 44 can also be non-integral with the cap so long as when the cap 42 covers the opening 14 of the container, the cap 42 causes a flange to insert into the channel 24 and block the gravity response member 36 from contacting the electric terminals 32, 34.

Tilt switches have previously been described in the prior art, but not incorporated with a supporting flange to prevent a gravity response member from resetting an electronic timer. Elements of tilt switches in the prior art may be incorporated into the embodiments of the present invention. Examples of tilt switches that may be adaptable with supporting flanges include: Lo (U.S. Pat. No. 7,115,824), Chou (U.S. Pat. No. 6,518,523), Treeby (U.S. Pat. No. 4,912,687), Bitko (U.S. Pat. Nos. 4,135,067, 5,198,628, and 4,409,040), Miller (U.S. Pat. No. 3,183,321), Breed (U.S. Pat. No. 5,457,293), and Blair (U.S. Pat. No. 5,155,308), each incorporated herein by reference in their entireties.

Electronic timers 38 for use in the apparatus include a microprocessor, circuitry, a power source 50, and a display 40 for displaying the length of time since the first and second electrical contact terminals 32, 34 were either electrically connected or electrically disconnected from each other. The type of timers used in the present invention can be any number of well-known timing devices used in the art. Examples of electronic timers that can reset a count-up time display include those disclosed by Tuttle (U.S. Pat. No.

6,232,677), Newman (U.S. Pat. No. 8,045,420), and Ditzig (U.S. Pat. No. 6,667,936), each incorporated by reference in their entireties.

To preserve battery life, the apparatus 10 may be fitted with an insulating pull tab 52 placed between a power source 50 and the terminal contacts 32, 34. The power source 50 is preferably a dry cell battery, but can be in the form of other power sources, such as a solar cell. Typical batteries for use in the apparatus 10 are lithium or alkaline batteries, such as those commonly found in watches, and are between 1 and 3 volts.

A pull tab 52 may be incorporated into the apparatus 10 that interrupts the flow of energy from the battery 50 to the electronic timer 38. The user may remove the pull tab 52 after purchasing the apparatus 10 so that the battery does not drain while the apparatus is sitting on a store shelf. When the pull tab 52 is removed the battery 50 can be in electrical contact with the electronic timer 38 via a wire 58 or other conductor that allows the battery 50 to power the electronic timer 38. The microprocessor preferably uses low power consumption solid state technology, such as low power complementary symmetry metal oxide semiconductor (CMOS) technology. The counting means of the electronic timer may be an oscillator with a counter and decoder in the circuitry. The oscillator is a source of electronic pulses having a particular frequency, such as a crystal oscillator. The electronic timer 38 circuitry counts the pulses of the oscillator, and when a certain number of pulses have been counted, corresponding to one-second, the timer sends a signal to display 40, such as an LCD display, on the apparatus 10. The circuitry may also count minutes and hours by the number of oscillated pulses, and sends the incremented time increases to the display 40. The electronic timer 38 restarts the display at 0 when the electric contact terminals 32, 34 complete an electric circuit, or when the electric contact terminals 32, 34 open an electric circuit. In a preferred embodiment, the timer 38 sends signals the display 40 to count up, that is, the display 40 will display how many seconds, minutes or hours it has been since the terminals contacts 32, 34 were last contacted or separated from each other. In other embodiments, the electronic timer 38 can count down from a predetermined time. The electronic timer 38 can also be connected to an alarm that alerts the user that a predetermined amount of time that has elapsed since medication 46 was last retrieved from the container 12.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

I claim:

1. A medicine container timing apparatus, comprising:

a) a container having a top opening;

b) said container including a tilt switch, the tilt switch having i) a housing having an inner bottom wall surface, and an inner peripheral wall surface that extends upwardly from a periphery of the inner bottom wall surface and that confines a channel therein, the channel having an upper region disposed above a lower region when the tilt switch is oriented in an upright direction, ii) a first electric contact terminal and a second electric contact terminal, the first and second electric contact terminals spaced apart from each other and disposed within the upper region of the channel, iii) a gravity response member within the channel, the gravity response member capable of applying an actuation force to the first and second electric contact terminals, the actuation force resulting from gravity acting on the gravity response member when the tilt switch is tilted at an angle exceeding a predetermined actuation angle, thereby causing the first and second electric contact terminals to contact each other;

c) an electronic timer in electrical connection with the tilt switch, the electronic timer capable of resetting a time of occurrence of an event on a time display; and, d) a cap capable of covering the top opening of the container, wherein the cap includes a supporting flange adapted to extend into the channel between the gravity response member and the first and second electric contact terminals, whereby the supporting flange extends into the channel and prevents the gravity response member from engaging the first and second electric contact terminals when the cap covers the top of the container and the tilt switch is tilted at the angle exceeding the predetermined actuation angle, thereby preventing resetting the time of occurrence of the event on the time display.

2. The apparatus of claim 1, wherein the gravity response member is a non-conductive ball capable of rolling from the lower region to the upper region of the channel.

3. The apparatus of claim 1, wherein the predetermined actuation angle is characterized as the angle created from a first orientation of the tilt switch to a second orientation of the tilt switch.

4. The apparatus of claim 3, wherein the angle created from the first orientation of the tilt switch to the second orientation of the tilt switch is at least 90 degrees.

5. The apparatus of claim 3, wherein the first orientation is a substantially upright orientation of the tilt switch and the second orientation is at least 90 degrees tilted from the upright orientation.

6. The apparatus of claim 1, wherein the supporting flange is a curved lower rim of the cap adapted to prevent the gravity response member from moving from the lower region of the channel to the upper region of the channel when the tilt switch is tilted at the angle exceeding the predetermined actuation angle.

7. The apparatus of claim 1, wherein the first and second electric contact terminals are spaced from each other and overlapping, thereby forming an open circuit when the tilt switch is in an upright orientation, and wherein the gravity response member causes the first and second electric contact terminals to contact each other when the tilt switch is tilted at the angle exceeding the predetermined actuation angle when the cap is not present.

8. The apparatus of claim 1, wherein the electronic timer includes a microprocessor, circuitry, a battery, and a display for displaying the length time since the first and second electrical contact terminals were either electrically connected or electrically disconnected from each other.

9. The apparatus of claim 1, wherein the electronic timer includes a microprocessor and a battery connected to the timer display, and wherein contact of the first and second electric contact terminals causes a change in an electrical condition to update numerals displayed on the timer display.

10. The apparatus of claim 1, wherein the gravity response member rests on the flange when the cap covers the top opening of the container and the tilt switch is tilted at the angle exceeding the predetermined actuation angle.

11. The apparatus of claim 1, wherein the channel further comprises an aperture, wherein the flange is capable of extending at least partially through the aperture.

12. The apparatus of claim 1, wherein at least one of the first and second electrical contact terminals is a spring loaded electrical contact terminal.

13. The apparatus of claim 1, wherein the channel is generally cylindrical and the gravity response member is round, whereby the apparatus can be tilted in any direction exceeding the predetermined actuation angle and the gravity response member will cause the first and second electrical contact terminals to contact each other.

14. The apparatus of claim 1, wherein the first and second electrical contact terminals provide an electrical short to circuitry that resets the electronic timer when the first and second electrical contact terminals contact each other.

15. A medicine container timing apparatus, comprising:

a) a container having a top opening;

b) said container including a tilt switch, the tilt switch having i) a housing having an inner bottom wall surface, and an inner peripheral wall surface that extends upwardly from a periphery of the inner bottom wall surface and that confines a channel therein, the channel having an upper region disposed above a lower region when the tilt switch is oriented in an upright direction, ii) a first electric contact terminal and a second electric contact terminal, the first and second electric contact terminals spaced apart from each other and disposed within the upper region of the channel, iii) a gravity response member composed of conductive material within the channel, the gravity response member capable of engaging both the first and second electric contact terminals simultaneously to close the circuit between them when the tilt switch is tilted at an angle exceeding a predetermined actuation angle;

c) an electronic timer in electrical connection with the tilt switch, the electronic timer capable of resetting a time of occurrence of an event on a time display; and, d) a cap capable of covering the top opening of the container, wherein the cap includes a supporting flange adapted to extend into the channel between the gravity response member and the first and second electric contact terminals, whereby the supporting flange extends into the channel and prevents the gravity response member from engaging the first and second electric contact terminals when the cap covers the top of the container and the tilt switch is tilted at the angle exceeding the predetermined actuation angle, thereby preventing resetting the time of occurrence of the event on the time display.

16. The apparatus of claim 15, wherein the angle created from the first orientation of the tilt switch to the second orientation of the tilt switch is at least 90 degrees.

17. The apparatus of claim 15, wherein the channel is generally cylindrical and the gravity response member is round, whereby the apparatus can be tilted in any direction exceeding the predetermined actuation angle and the gravity response member will cause the first and second electrical contact terminals to contact each other.

18. A method for determining the last time a patient has removed medication from a medicine container, the method comprising:

a) providing a medicine container timing apparatus, the apparatus comprising:

a container having a top opening;

the container including a tilt switch, the tilt switching having a housing having an inner bottom wall surface, and an inner peripheral wall surface which extends upwardly from a periphery of the inner bottom wall surface and which confines a channel therein, the channel having an upper region disposed above a lower region in an upright direction; a first electric contact terminal and a second electric contact terminal, the first and second electric contact terminals spaced apart from each other and disposed within the upper region of the channel; a gravity response member within the channel, a gravity response member within the channel, the gravity response member capable of applying an actuation force to the first and second electric contact terminals, the actuation force resulting from gravity acting on the gravity response member when the tilt switch is tilted at an angle exceeding a predetermined actuation angle thereby causing the first and second electric contact terminals to contact each other;

an electronic timer in electrical connection with the tilt switch, the electronic timer capable of resetting a time of occurrence of an event on a time display;

a cap capable of covering the top opening of the container, wherein the cap includes a supporting flange adapted to extend into the channel between the gravity response member and first and second electric contact terminals;

b) removing the cap;

c) tilting the tilt switch at an angle exceeding the predetermined actuation angle;

d) applying the actuation force against the first and second electric contact terminals;

e) generating an indication of time relating to a time of occurrence of tilting the tilt switch.

19. The method of claim 18, wherein generating an indication of time is resetting an electronic timer in response to the tilt switch being tilted from a generally upright orientation to an angle exceeding 90 degrees from the substantially upright orientation, or wherein generating an indication of time is resetting an electronic timer in response to the tilt switch being tilted from an angle exceeding 90 degrees from the substantially upright orientation to the substantially upright orientation.

20. The method of claim 18, further comprising the step of removing medication from the medicine container timing apparatus.

* * * * *